United States Patent [19]

Fukasawa et al.

[11] Patent Number: 4,634,161

[45] Date of Patent: Jan. 6, 1987

[54] AUTOMOTIVE OUTSIDE DOOR HANDLE UNIT

[75] Inventors: Takeshi Fukasawa, Yokohama; Isamu Uemura, Yokosuka, both of Japan

[73] Assignee: Kokusan Kinzoku Kogyo Kabushiki Kaisha, Tokyo, Japan

[21] Appl. No.: 676,319

[22] Filed: Nov. 29, 1984

[51] Int. Cl.[4] ..... E05C 21/00

[52] U.S. Cl. ..... 292/336.3; 292/347; 292/DIG. 38; 264/318; 264/DIG. 71; 264/328.1

[58] Field of Search ..... 292/336.3, DIG. 38, 292/DIG. 31, 347, 1; 264/318, DIG. 71, 328.1, 272.13, DIG. 42

[56] References Cited

U.S. PATENT DOCUMENTS

| | | | |
|---|---|---|---|
| 3,967,844 | 7/1976 | Torii et al. | 292/336.3 |
| 4,270,668 | 6/1981 | Berfield | 292/DIG. 38 X |
| 4,502,715 | 3/1985 | Lundblode | 292/DIG. 38 X |

*Primary Examiner*—Richard E. Moore

*Attorney, Agent, or Firm*—Fleit, Jacobson, Cohn & Price

[57] ABSTRACT

An automotive outside door handle unit includes a plastic resin-made outside door handle proper and two operating arms. These arms are mechanically connected with door lock means arranged in an automotive door. The handle proper and the operating arms are united rigidly into one piece with a plastic resin material. The unit is characterized by the formation of a material-thefting bridge structure formed at the uniting root end of the operating arm for the prevention of otherwise formation of defective contraction marks during molding.

2 Claims, 4 Drawing Figures

FIG. 1
(PRIOR ART)
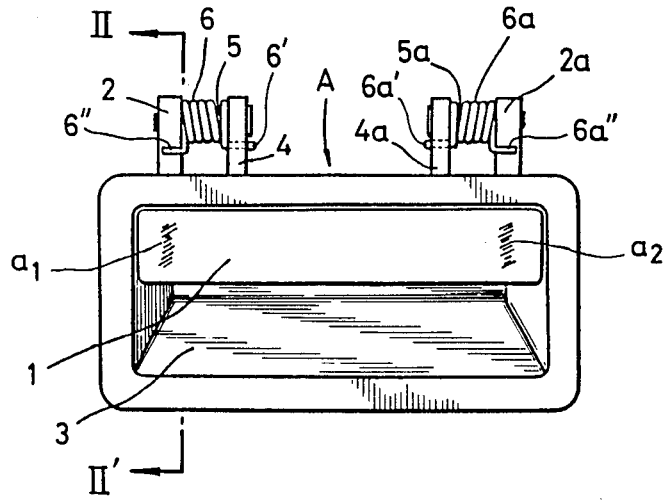
FIG. 2
(PRIOR ART)
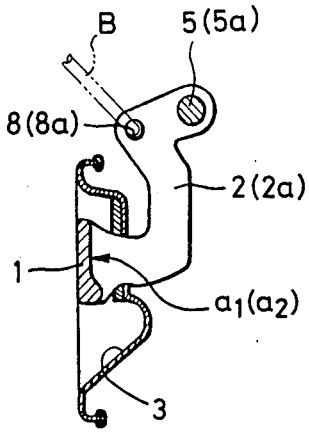
FIG. 3
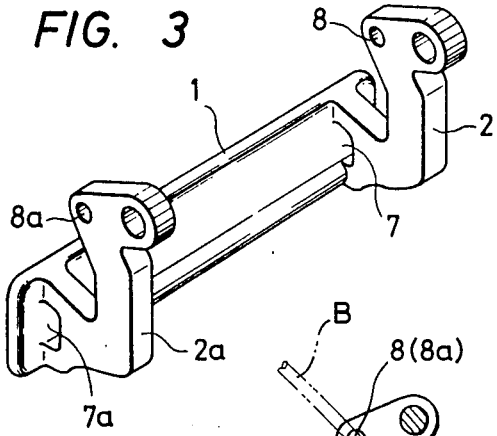
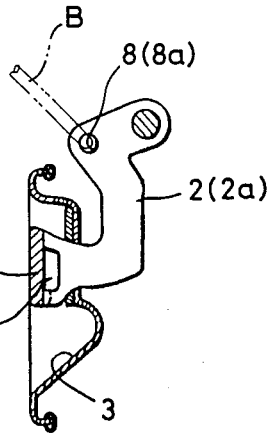
FIG. 4

AUTOMOTIVE OUTSIDE DOOR HANDLE UNIT

BACKGROUND OF THE INVENTION

The present invention relates to improvements in and on an automotive outside door handle unit mounted on an automotive vehicle door. As is commonly known, such door handle unit is mounted on the door in such a way that the door can be made ready for being opened by manually raising the door handle proper from outside and then be really opened by drawing it towards the outside operator if an inside push button has been already pushed down from vehicle inside.

Hitherto known such automotive outside door handle units have been made by zinc die-casting or from steel sheets through press jobs. Rather recently, however, they are made of plastic resin, for the purpose of weight reduction.

As is well known, this kind of automotive outside door handle unit comprises an outside door handle proper and at least one, generally two operating arms which are mechanically connected with door lock means arranged in or an automotive door. The said handle proper and the said operating arms are united rigidly into one piece with a plastic resin material.

It has been experienced, however, that defective contraction marks appear on the front surface of the handle proper during the molding step thereof and opposite to the uniting root ends of the operating arms. If formulation of these contraction marks should be brought about, the products will be degraded in their commercial value.

SUMMARY OF THE INVENTION

It is, therefore, an object of the present invention is to provide automotive outside door handle units which represent substantially no such disadvantageous contraction marks.

For attaining such object, the automotive outside door handle unit according to this invention comprises an outside door handle proper and at least an operating arm which is mechanically connected with door lock means arranged in an automotive door, the said handle proper and the said operating arm being united rigidly into one piece with a plastic resin material, is characterized by the formation of a material-thefting bridge structure formed at the uniting root end of the said operating arm.

This and further objects, features and advantages of the invention will appear more clearly as the description proceeds with reference to the accompanying drawings, in which:

BRIEF DESCRIPTION OF THE DRAWING

FIG. 1 is a front view of the door handle unit representing a preferred embodiment of the invention, wherein, however, the conventional formation of disadvantageous contraction mark is addedly shown intentionally for the demonstration of conventional defects.

FIG. 2 is a cross-section taken along a section line II—II' in FIG. 1, wherein, however, the operation arm is shown as of the conventional style.

FIG. 3 is a perspective view of the handle proper when seen from the rear side thereof, especially for the illustration of the conventional operation arms solidly attached thereto.

FIG. 4 is a similar, but somewhat enlarged cross-sectional view to FIG. 3, wherein, however, the operation arm is shown as of the inventive style.

DETAILED DESCRIPTION OF PREFERRED EMBODIMENTS

In the following, a preferred embodiment of the present invention will be described in detail and with reference to the accompanying drawing:

Before entering into the invention, a comparative conventional arrangement of an automotive outside door handle which constitutes the background of the invention will be described briefly.

The conventional outside door handle is denoted generally by a reference character "A" in FIG. 1.

Reference character 1 represents the outside door handle proper made of a hard and rigid plastic resin such as a phenolic one. A pair of remote arm members 2 and 2*a* are made rigid with the door handle proper 1. Numeral 3 represents a housing piece made again of hard and rigid plastic resin and adapted for housing the door handle proper 1 as shown.

4 and 4*a* represent a pair of mutually remote, supporting stems which are rigid with the rear portion of the said housing piece 3, although the respective connecting portions therebetween are not specifically shown.

Each pair of the arm 2 or 2*a* and the stems 4 or 4*a* are mutually and pivotably connected by means of a pivot pin 5 or 5*a*, respectively. Therefore, the handle proper 1 can be manipulated to turn relative to the housing piece 3 and around the common axis, not shown, through the both pins 5 and 5*a*.

One stop end 6' of a return spring 6 surrounding the pin 5 abuts the stem 4, while the opposite stop end 6'' thereof abuts on the related arm member 2 for preserving return energy within the coil spring 6. Similar arrangement is made with the other coil spring 6*a* relative to the similar members 2*a* and 4*a*. Similar stop ends of coil spring 6*a* are denoted with 6*a'* and 6*a''*, respectively.

Arm members 2 and 2*a* are formed with respective connecting openings 8 and 8*a* which mechanically linked through link means B, so as to unlock the door lock by raising the handle proper 1. Upon release of the once raised handle proper, the door lock will be brought again into locked position under the influence of return spring action at 6 and 6*a*.

With the prior art automotive outside handle unit "A" so far shown and described, it has been specifically experienced that disadvantageous contraction marks will appear at the time of molding formation of the handle proper 1 and on the front surface thereof, as hinted schematically by $a_1$ and $a_2$, and in correspondence to the root- or attaching portions of the arm members 2 and 2*a*, respectively.

These portions $a_1$ and $a_2$ are clearly seen when seeing FIG. 2 in combination with FIG. 1.

For avoiding the above defect, and in accordance with the characterizing feature of the invention, the attaching root portion of each arm 2 or 2*a*, is formed with a material-thefting bridging portion 7.

These material-thefting bridges 7 and 7*a* will be seen more clearly by reviewing FIGS. 3 and 4.

As ascertained by our practical experience and clearly understood from the foregoing description, the inventively improved automotive outside door handle unit can obviate otherwise possible disadvantageous formation of defective contraction marks such as shown and described with $a_1$ and $a_2$ in the foregoing, in a highly simplified manner, which constitutes a remarkable merit.

The embodiments of the invention which an exclusive property or privilege is claimed are as follows:

1. An automotive outside door handle comprising:

a one piece door handle assembly including a door handle and an operating arm, said door handle being elongated and having an inner side and an outlet side defining opposite sides of said door handle, one end of said operating arm includng two leg portions spaced apart from one another and a crosspiece interconnecting said two leg portions, said two leg portions each having one end terminating at said inner side of said door handle and each having another end terminating at said crosspiece, and said two leg portions, said inner side of said door handle, and said crosspiece spaced away from said inner side of said door handle defining an open, material thefting bridging portion shaped for preventing contraction marks from forming on said outer side of said door handle during manufacture of said door handle assembly.

2. An automotive outside door handle as claimed in claim 1, wherein said door handle assembly is made of a plastic resin material.

* * * * *